United States Patent [19]

DeSchaaf et al.

[11] 3,997,201

[45] Dec. 14, 1976

[54] APPLIANCE DOOR LATCH

[75] Inventors: Clifford L. DeSchaaf; Ray W. Spiegel, both of Stevensville, Mich.

[73] Assignee: Whirlpool Corporation, Benton Harbor, Mich.

[22] Filed: July 9, 1975

[21] Appl. No.: 594,452

[52] U.S. Cl. ..... 292/173

[51] Int. Cl.[2] ..... E05C 1/06

[58] Field of Search ..... 292/144, 166, 173, 201, 292/DIG. 69; 70/432, 441, 241, DIG. 49

[56] References Cited

UNITED STATES PATENTS

| | | | |
|---|---|---|---|
| 1,361,317 | 12/1920 | Dulcyewski et al. | 29/144 X |
| 2,284,427 | 5/1942 | Hufferd et al. | 16/169 X |
| 2,715,542 | 8/1955 | Gould | 292/166 X |
| 2,786,701 | 3/1957 | Povlich | 292/144 |
| 2,934,074 | 4/1960 | Low | 134/58 |
| 3,005,065 | 10/1961 | Jellies | 200/61.62 |
| 3,007,479 | 11/1961 | Jacobs et al. | 134/58 |
| 3,415,961 | 12/1968 | Barnard | 200/61.64 |
| 3,450,851 | 6/1969 | Perl | 200/61.68 |
| 3,556,573 | 1/1971 | Miller | 292/143 |
| 3,684,343 | 8/1972 | Hancock | 312/223 |
| 3,820,361 | 6/1974 | Leitner | 70/241 |

*Primary Examiner*—Richard E. Moore
*Attorney, Agent, or Firm*—Wegner, Stellman, McCord, Wiles & Wood

[57] ABSTRACT

An improved latch structure for releasably locking a door to a cabinet including switch structure for permitting operation of electrical apparatus associated therewith to be operated only when the door is in the latched closed position. The switch is hidden within the door behind the latch bolt so as to be operated substantially only by the strike which has a preselected configuration to effect the latching and switch operating operations. The bolt may be operated manually to release the door from the latched condition, and in the illustrated embodiment, an improved pivotally mounted operator is provided for effecting the desired unlatching movement of the bolt.

21 Claims, 9 Drawing Figures

APPLIANCE DOOR LATCH

BACKGROUND OF THE INVENTION

1. Field of the Invention

This invention relates to latching means and in particular to means for latching a door in a closed position and concurrently providing an electrical switch control for apparatus associated therewith.

2. Description of the Prior Art

In a number of different appliances, a door is provided for closing and opening thereof. Concurrently, a switch may be suitably actuated by the closing of the door to potentiate electrical apparatus of the appliance. In the illustrated invention herein, a dishwasher is provided with a cabinet having a front opening which is selectively closed by a front door. The door carries a switch which is actuated when the door is latched closed to permit operation of the dishwasher electrical apparatus.

The use of latch-controlled switches in connection with such appliances is illustrated in the Frank D. Low U.S. Pat. No. 2,934,074 wherein an electrical control system is actuated as a latch or the like is manipulated to disengage the strike and keeper elements of the latch. In the Low device, the switch is carried on a pivotal keeper and engages a tongue of the keeper adjacent an opening therein so as to be subsequently engaged by the strike in the closed position of the door wherein the nose of the strike extends downwardly through an opening adjacent the portion of the tongue engaged by the switch actuator. In Low, the switch may be actuated by the user when the door is in the open position as the actuator thereof is exposed through the opening in the keeper.

In U.S. Pat. No. 3,007,479 of James W. Jacobs et al., a latching mechanism for a washing apparatus is shown having an actuating lever connected at its opposite ends with latch bolts which are moved horizontally when an actuating lever is rotated. The bolt carries a push-button electrical switch. When the bolt is in the unlatched position, the switch assumes its normal open position, and when the latch bolt is projected into the keeper slot by rotation of the handle, the nose of the bolt moves into the slot and at the same time, the switch moves with the bolt to a position wherein the actuator is depressed.

Walter C. Barnard U.S. Pat. No. 3,415,961, owned by the assignee hereof, shows a latch mechanism for use in dishwashers and the like having a latch urged upwardly through an opening in a rear panel when the door is in the open position. The latch pivots on a crank rod so as to permit a portion thereof to move freely upwardly through an opening in the front cabinet wall to dispose the catch rearwardly of the strike. A latch handle may then be depressed to pivot the latch and bring the catch into engagement with a turned end of the strike. A spring is provided for biasing the latch in the latching position, positioning the latch in the normal open position, and biasing the actuator in the switch-actuating position.

In U.S. Pat. No. 3,684,343, Charlie L. Hancock shows a latch switch arrangement for a dishwasher wherein a latch strike, switch, and cover for the switch form an interfitted assembly removable from the dishwasher while leaving the tub thereof below the countertop.

Richard L. Perl, in U.S. Pat. No. 3,450,851, shows a door latch mechanism including a strike which engages a resilient keeper mechanism mounted on the door and operated by a release mechanism carried within the door. The latch has a pushbutton release which opens switch contacts to prevent operation of the electrical apparatus prior to the opening of the door. The strike has a spear-form head and spring biased rollers which are wedged apart to free the strike head.

Wallace W. Miller, in his U.S. Pat. No. 3,556,573, shows an astragal mounted flush bolt having a manual operating level in the side of the astragal which is accessible even when the door is closed.

David A. Jellies, in U.S. Pat. No. 3,005,065, shows a domestic appliance having a rotating latch member in a dishwasher wherein a cam surface is provided on the rotating latch member for actuating a door switch mounted in the door. The danger in permitting a control switch to be exposed when the appliance door is in the open position is discussed by Jellies and points up the need for effectively preventing such operation as by a playful or mischievous child, etc. In the Jellies patent, when the door is placed in the closed position wherein the bolt is capable of latching behind the head of the strike, the strike head engages a portion of a lever to move the lever suitably to release the bolt and thereby permit movememt of the operating handle to the latching position.

SUMMARY OF THE INVENTION

The present invention comprehends an improved structure for releasably locking a door in a closed position and concurrently potentiating electrical apparatus. The invention comprehends an arrangement of the structure effectively preventing operation of the control switch other than by the strike structure. Thus, undesirable operation of electrical apparatus controlled by the switch is effectively precluded.

In the illustrated embodiment, the control switch is mounted behind the bolt and the bolt is accessible to the strike through a small opening adjacent one end of the bolt effectively precluding insertion of tools and the like through the opening in an effort to improperly operate the switch.

The switch, in being mounted to the rear of the bolt, is movable with the bolt as the bolt is moved from and to the latching position.

The latching movement of the bolt is effected automatically by the strike engaging an inclined end surface of the bolt as the door is brought to the closed position. In the closed position, the strike projects sufficiently through the opening so as to dispose an aperture in the strike in alignment with the end of the bolt, permitting the bolt to be biased to the latching position wherein the end of the bolt extends through the strike aperture.

Concurrently, the biasing means urges the actuator of the switch carried by the bolt against an actuating portion of the strike whereby the switch is thrown to permit operation of the electrical apparatus of the appliance.

Manual operating means may be provided for moving the bolt to retract the latching portion thereof from the strike aperture and concurrently move the switch from the actuating portion to de-energize the electrical apparatus and permit swinging of the door to the open position.

The invention comprehends further the provision of improved means for effecting movement of the bolt by the manually operable handle. In the illustrated embodiment of the invention, the bolt is moved by a lever which is pivotally mounted adjacent the bolt. The manually operable handle is pivotally connected to the lever and means are provided for guiding the handle suitably toward and from the lever to effect the swinging of the lever suitably to urge the bolt from the latched position to permit moving of the door from the closed position.

In the illustrated embodiment, the pivot means comprises a pair of pins, each having an annular groove. The lever carries key means adapted to project into the grooves to prevent axial movement of the pins. Illustratively, the key means may be formed integrally with the lever where the lever is formed of a resilient material, such as molded plastic. The lever may be readily removed as for servicing by release of the key means from one or both of the annular grooves to permit withdrawal of one or both of the pivot pins as may be required.

Thus, the invention comprehends an improved structure for releasably locking a door in a closed position across an appliance cabinet opening and permitting operation of electrical apparatus associated therewith only when the door is latched in the closed position.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
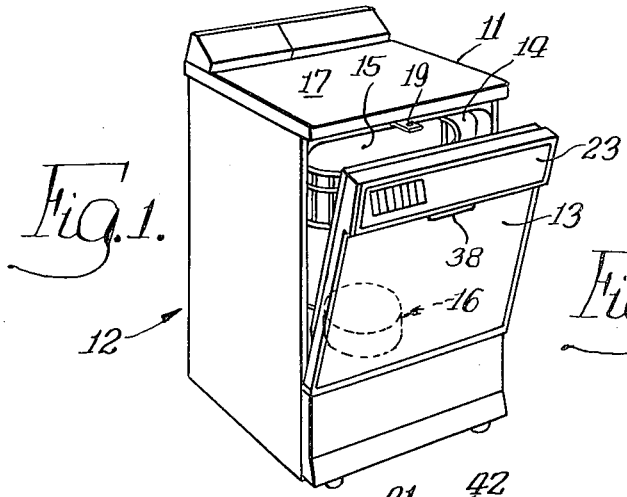
FIG. 1 is a perspective view of a dishwasher having a door latching structure embodying the invention.
Figure 3:
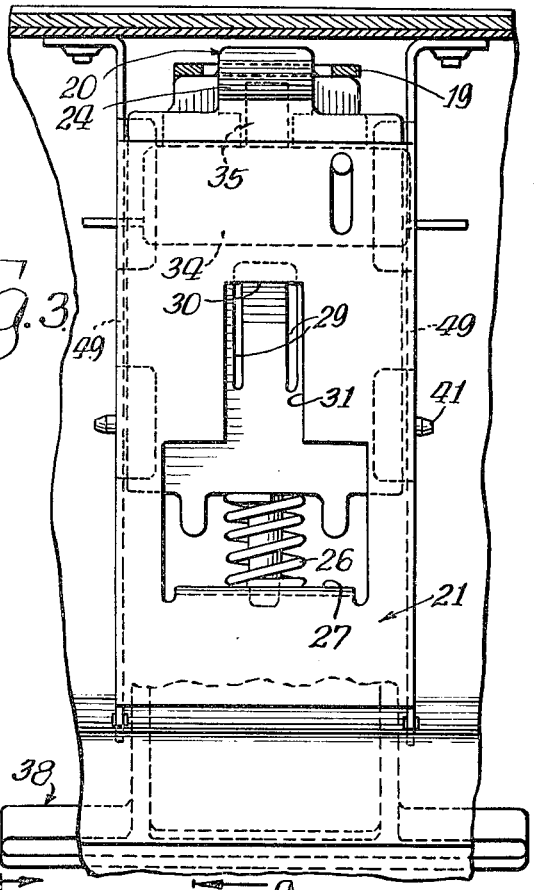
FIG. 3 is a fragmentary transverse vertical section taken substantially along the line 3—3 of FIG. 2.

In the exemplary embodiment of the invention as disclosed in the drawing, an improved latching structure generally designated 10 is shown for use in latching a door in a closed position across an opening of a cabinet. In the illustrated embodiment, the cabinet comprises the cabinet 11 of an appliance 12, illustratively comprising a dishwasher apparatus. A bottom hinged door 13 is provided for selectively closing the front opening 14 of the cabinet for providing controlled access to a dishwashing space 15 therein. The cabinet includes a top wall 17 which, at its forward end, defines the upper portion of the front opening 14, as illustrated in FIG. 2.

The appliance may be provided with electrically powered apparatus, such as electrical apparatus 16 of the dishwasher. Latching structure 10 further includes switch means generally designated 18 which is arranged to permit operation of electrical apparatus 16 only when the door is latched closed across opening 14.

More specifically, the latching structure includes a strike 19 secured to the cabinet wall 17 to project forwardly through opening 14 for engagement with a bolt generally designated 20. Bolt 20 is mounted on a support plate 21 within the outer housing generally designated 22 of the door and more specifically, within a console portion 23 of the housing. The bolt defines a beveled, or inclined, upper end surface 24 adapted to be engaged by the outer, or distal, edge 25 of the strike as the door is swung to the closed position. The engagement of strike portion 25 with bolt surface 24 urges the bolt downwardly against the biasing action of a coil spring 26 compressed between a spring retainer 27 on support plate 21, and a spring retainer portion 28 on the lower portion of bolt 20. Upward movement of the bolt is limited by the engagement of a shoulder 29 thereof with a shoulder portion 30 of the support defining an upper edge of a vertical slot 31 in the support plate.

Figure 2:
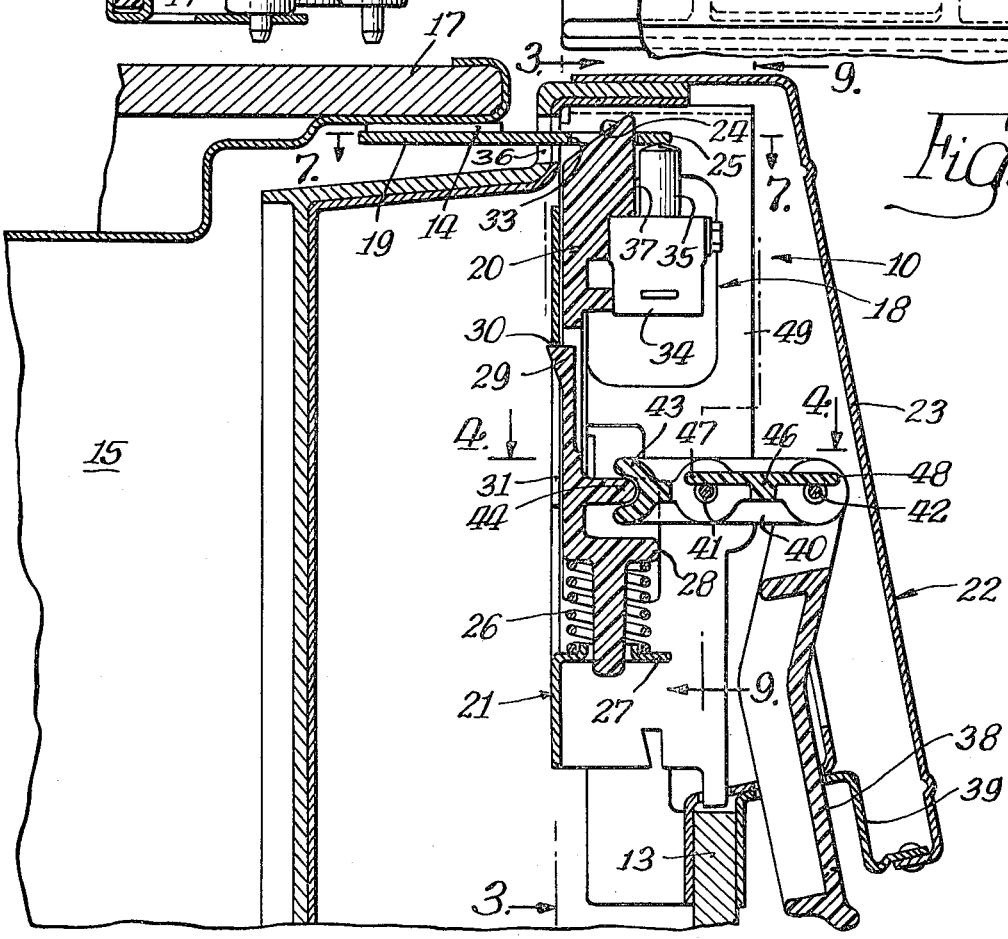
FIG. 2 is a fragmentary enlarged vertical section of the door latching structure of FIG. 1.
Figure 6:
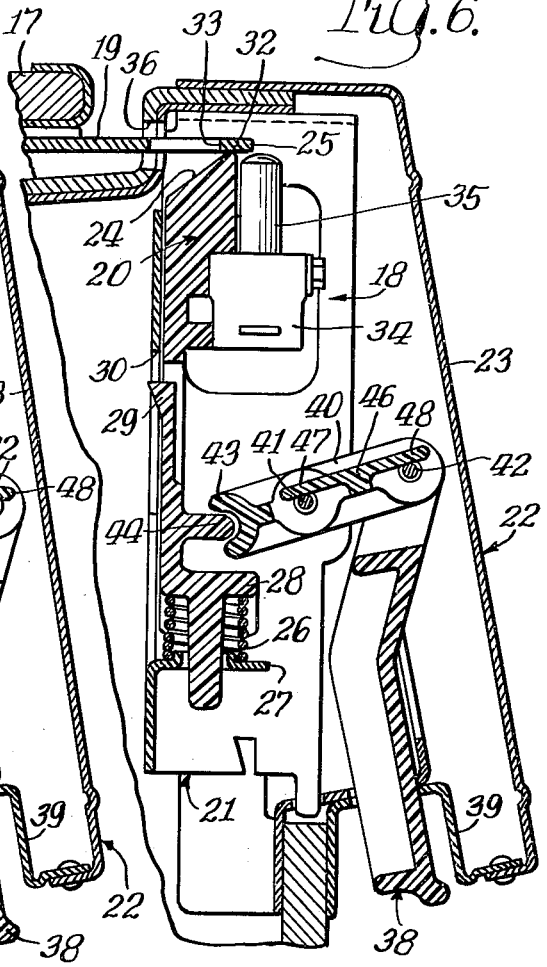
FIG. 6 is a view similar to that of FIG. 5 with the door brought further to the closed position.
Figure 7:
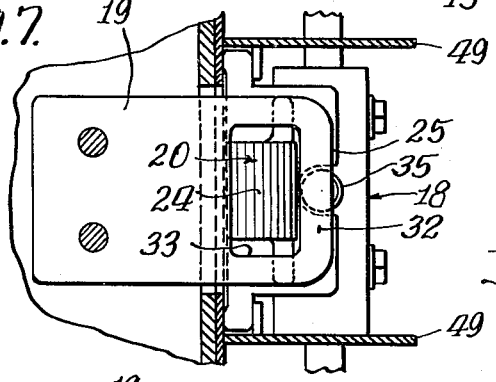
FIG. 7 is a horizontal section taken substantially along the line 7—7 of FIG. 2.
Figure 8:
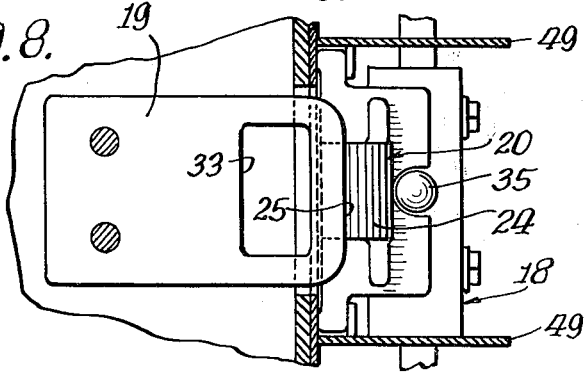
FIG. 8 is a horizontal section taken substantially along the line 8—8 of FIG. 5.

As seen in FIG. 6, as the door is brought more fully to the closed position, the bolt moves along strike edge 25 so as to cause the upper end of the bolt to move along a lower surface or actuating portion 32 rearwardly of the strike end 25, the bolt being maintained in the depressed position of FIG. 6 until the door is swung sufficiently in a counterclockwise direction, as seen in FIG. 6, to bring the bolt in alignment with an aperture 33 in the strike whereupon spring 26 urges the bolt upwardly into the aperture to effect a latching of the door in the closed position of FIG. 2. As shown in FIG. 2, the transverse dimension of the latch aperture is larger than that of the corresponding dimension of the portion of the bolt extending therethrough so as to permit free reception of the bolt therein under the action of spring 26 to effectively positively latch the door in the closed position with the bolt rear surface portion captured behind shoulder portion 33a of the strike.

At the same time that the bolt is brought upwardly into aperture 33, switch means 18 is caused to be actuated. More specifically, as seen in FIG. 2, switch means 18 includes a switch 34 provided with an actuator button 35 projecting upwardly therefrom so as to be engaged by the actuating portion 32 of strike 19 when the bolt moves upwardly to the latched position. As shown in FIG. 6, as long as the bolt remains depressed by the actuating portion 32, the actuator button 35 of switch 34 remains extended, maintaining electrical apparatus 16 de-energized and preventing undesirable operation of the appliance. Actuator 35 may be spring biased upwardly and the invention comprehends the preselection of the spring constant of spring 26 to provide a greater biasing force than that of the actuator so as to permit the desired actuation of switch 34 by the upward movement of the bolt to the position of FIG. 2.

Figure 5:
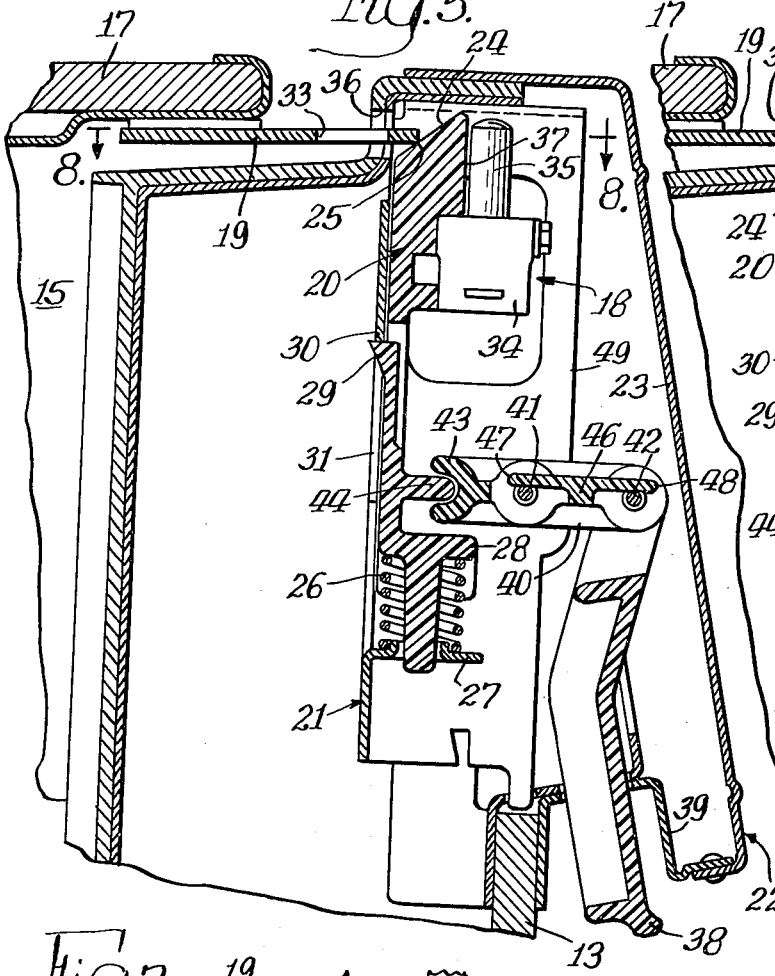
FIG. 5 is a vertical section generally similar to that of FIG. 2, but illustrating the arrangement of the structure as the door is being brought to the closed position of FIG. 2.

As can be seen in FIG. 5, as the door is swung to the closed position, the strike end 25 moves into the door through an access opening 36 which provides only limited access to the bolt means. Switch 34 is mounted to the rear surface 37 of the bolt (i.e., the surface facing away from the opening 36) so as to be effectively mounted behind the bolt and, thus, is inaccessible through the opening 36 as by conventional tools, such as screwdrivers, and the like. One attempting to defeat the safety arrangement of the structure by inserting a screwdriver, or the like, through the access opening, can only depress the bolt carrying downwardly with it the switch so as to be effectively prevented from operating the switch by such conventional tools.

When it is desired to open the door from the latched arrangement of FIG. 2, the operator need merely manipulate a handle 38 extending downwardly through a lower portion 39 of the console 23. Handle 38 is connected to a lever 40 which is pivotally mounted to the support 21 by a first pivot means 41 adjacent the bolt 20. Guide means are provided for limiting movement of the handle 38 to linear travel at an angle to the lever, and the handle 38 may be pivotally connected to the lever by a second pivot means 42 and the lever may be movably connected to the bolt by a jaw 43 engaging a tongue 44 of the bolt, as illustrated in FIG. 2.

Referring now to FIG. 6, when handle 38 is urged upwardly into console 23, lever 40 is swung about pivot means 41 to move jaw 43 downwardly, thereby urging the bolt 20 downwardly and removing the strike from aperture 33.

Figure 4:
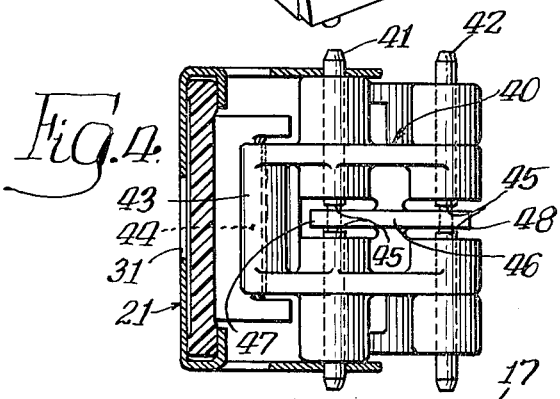
FIG. 4 is a fragmentary horizontal section taken along the line 4—4 of FIG. 2.
Figure 9:
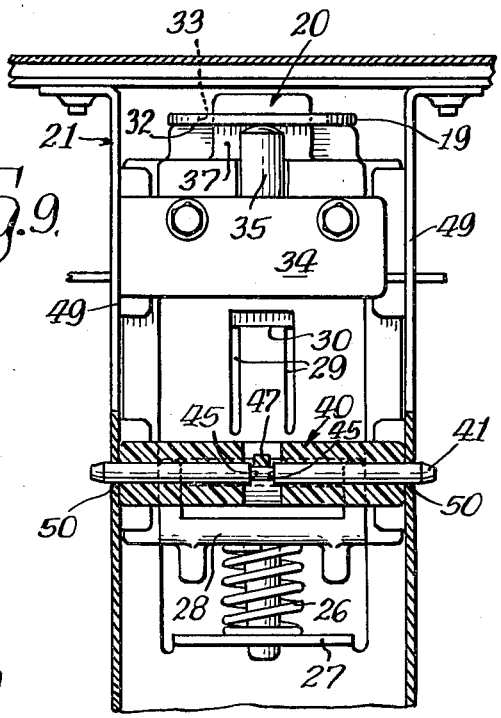
FIG. 9 is a vertical section taken substantially along the line 9—9 of FIG. 2.

The lever 40 may be formed of molded plastic and the pivot means 41 and 42 may comprise pivot pins, each of which may be provided with an annular recess 45 in its mid-portion (see FIG. 4). The lever may include an integral key structure 46 defining a first deflectable key 47 received within the groove of the first pivot means 41 and a second deflectable key 48 received within the groove of the second pivot means 42 for locking the pins against axial movement. As shown in FIG. 9, support 21 may include a pair of spaced side walls 49 carrying the opposite ends 50 of the pins.

Thus, the invention comprehends an improved latching structure for releasabl, latching the door of an appliance or the like in a cl ed position and permitting operation of electrical apparatus associated with the appliance only when the door is closed in the latched position. The strike and bolt define cooperating abutment means for effecting movement of the bolt against the action of a biasing spring, and the strike further defines an actuating means for actuating the control switch when the bolt moves into latched relationship with the strike. The switch is effectively hidden by the bolt to prevent unauthorized operation thereof as when the door is in the open position. The means for releasing the bolt comprises improved facilitated pivotal connecting means for connecting a handle to the bolt.

The foregoing disclosure of specific embodiments is illustrative of the broad inventive concepts comprehended by the invention.

We claim:

1. In an appliance having a cabinet defining an opening selectively closed by a door, and electrical apparatus therein, improved structure for releasably latching the door in a closed position across said opening and permitting operation of the electrical apparatus only when said door is latched in said closed position, comprising: a strike carried by the cabinet; a bolt movably carried by the door; a switch carried by the bolt for movement therewith for controlling electrical operation of said electrical apparatus; means for releasably biasing the bolt toward a latching position preselected to provide engagement between the strike and bolt as the door is brought to said closed position; abutment means on said strike and bolt causing movement of the bolt against the action of said biasing means as a result of said engagement, said abutment means being arranged to release said bolt for biasing by said biasing means to said latching position when the door is in the closed position; actuating means on said strike for actuating said switch, said biasing means causing said switch to be actuated by said actuating means when said bolt is released with the door in said closed position; cooperating means on said strike and bolt for releasably holding the door in said closed position with said bolt in said latching position and said switch being actuated; and manually operable means for moving said bolt for selective release of said strike and switch.

2. The appliance door locking structure of claim 1 wherein said door is provided with means for preventing access to said bolt other than adjacent said abutment means.

3. The appliance door locking structure of claim 1 wherein said abutment means includes a beveled end surface on said bolt and a leading portion of said strike slidably engageable with said end surface, said bolt further defining a rear wall at the inner end of said end surface, said switch being mounted to said rear wall to be actuated by said actuating means upon movement of said strike leading portion beyond said rear wall.

4. The appliance door locking structure of claim 1 wherein said abutment means includes a beveled end surface on said bolt and a leading portion of said strike slidably engageable with said end surface, said bolt further defining a rear wall at the inner end of said end surface, said switch being mounted to said rear wall to be actuated by said actuating means upon movement of said strike leading portion beyond said rear wall, said actuating means comprising a portion of the strike adjacent said leading portion.

5. The appliance door locking structure of claim 1 wherein said bolt is rectilinearly reciprocably movably mounted to said door.

6. The appliance door locking structure of claim 1 wherein said strike comprises a wall element defining a distal end and having an opening adjacent said distal end, said distal end defining a portion of said abutment means.

7. The appliance door locking structure of claim 1 wherein said strike comprises a wall element defining a distal end and having an opening adjacent said distal end, said distal end defining said actuating means.

8. The appliance door locking structure of claim 1 wherein said strike comprises a wall element defining a distal end and having an opening adjacent said distal end, said opening having a cross section larger than that of said bolt to permit free movement of said bolt therethrough by said biasing means, said distal end defining a portion of said abutment means.

9. The appliance door locking structure of claim 1 wherein said door is provided with enclosure means enclosing said bolt and switch and provided with an opening for projection of said strike therethrough, said switch being mounted on said bolt to be hidden by said bolt relative to said opening.

10. The appliance door locking structure of claim 1 wherein said manually operable means includes pivot means carried by the door, handle means connected to the pivot means, and means for moving said bolt in a rectilinear path as an incident of pivoting of said pivot means by said handle means.

11. Latching apparatus for releasably locking a pivotally mounted appliance door in a closed position on an appliance including electrical components, said latching apparatus comprising:

bolt means carried by said door for rectilinear movement relative to said door, strike means extending from said appliance toward said door for moving said bolt as said door approaches said closed position and engageable with said bolt in said closed position to lock said door closed, switch means carried by said bolt means for movement with said bolt means and responsive to said strike means for energizing said electrical components with said door locked in said closed position, and manually operable means for selectively moving said bolt means to unlock said door.

12. The latching apparatus of claim 17 wherein said manually operable means for moving said bolt includes a lever, first pivot means for pivotally mounting the lever adjacent said bolt, means on said lever movably engaging said bolt for rectilinearly reciprocably moving said bolt as as incident of selective reciprocable pivoting of said lever, a handle, second pivot means for pivotally connecting said handle to said lever, and means for guiding movement of said handle angularly to said lever to effect pivoting of the lever and corresponding rectilinear movement of said bolt as an incident of guided manual operation of said handle.

13. The latching apparatus of claim 12 wherein said first pivot means includes a pivot pin having an annular groove, and key means are carried by said lever for reception in said groove to prevent axial movement of said pivot pin.

14. The latching apparatus of claim 12 wherein said second pivot means includes a pivot pin having an annular groove and key means are carried by said lever for reception in said groove to prevent axial movement of said pivot pin.

15. The latching apparatus of claim 12 wherein said first pivot means includes a pivot pin having an annular groove, and key means are formed integrally with said lever for reception in said groove to prevent axial movement of said pivot pin.

16. The latching apparatus of claim 12 wherein each of said pivot means includes a pivot pin having an annular groove, and key means are carried by said lever for reception in said grooves to prevent axial movement of said pivot pins.

17. The latching apparatus as claimed in claim 11 wherein the strike means includes a lower surface portion for contacting and moving said bolt means as said door approaches said closed position and a shoulder portion for engaging with said bolt means with said door in said closed position.

18. The latching apparatus as claimed in claim 17 wherein spring means biases said bolt means against said lower surface portion and said lower surface portion moves said bolt means against said spring means as said door approaches said closed position, said spring means moving said bolt means into engagement with said shoulder portion upon said bolt means clearing said lower surface portion and said shoulder portion with said door closed.

19. The latching apparatus as claimed in claim 11 wherein said bolt is mounted within said appliance door and the inside wall of said door defines an opening adjacent said bolt means for receiving said strike means therethrough.

20. The latching apparatus as claimed in claim 19 wherein normal access to said bolt means is normally only through said opening and wherein such access is substantially limited by the size of said opening.

21. The latching apparatus as claimed in claim 20 wherein said switch means is mounted on the side of said bolt means facing away from said opening so as to be substantially shielded from said opening by said bolt means.

* * * * *